US011355870B2

(12) United States Patent
Koellmann et al.

(10) Patent No.: US 11,355,870 B2
(45) Date of Patent: Jun. 7, 2022

(54) CONDUCTOR TERMINAL

(71) Applicant: WAGO Verwaltungsgesellschaft mbH, Minden (DE)

(72) Inventors: Hans-Josef Koellmann, Minden (DE); Michael Meyer, Wiedensahl (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/101,880

(22) Filed: Nov. 23, 2020

(65) Prior Publication Data

US 2021/0159618 A1 May 27, 2021

(30) Foreign Application Priority Data

Nov. 22, 2019 (DE) ..... 10 2019 131 653.7

(51) Int. Cl.

| | |
|---|---|
| ***H01R 4/48*** | (2006.01) |
| ***H01R 9/24*** | (2006.01) |
| ***H01R 13/502*** | (2006.01) |
| ***H01R 25/14*** | (2006.01) |

(52) U.S. Cl.

CPC ..... *H01R 4/4845* (2013.01); *H01R 4/4836* (2013.01); *H01R 9/2416* (2013.01); *H01R 13/502* (2013.01); *H01R 25/14* (2013.01)

(58) Field of Classification Search

CPC .. H01R 4/4845; H01R 4/4836; H01R 9/2416; H01R 13/502; H01R 25/14; H01R 9/2675; H01R 4/48; H01R 4/4854; H01R 2101/00; H01R 11/09; H01R 9/24; H01R 25/16; H01R 43/20; H01R 4/4818; H01R 12/85

See application file for complete search history.

(56) References Cited

U.S. PATENT DOCUMENTS

| | | | | |
|---|---|---|---|---|
| 9,525,219 | B2 * | 12/2016 | Kollmann | H01R 4/4845 |
| 9,543,700 | B2 * | 1/2017 | Kollmann | H01R 4/4836 |
| 2016/0352028 | A1 * | 12/2016 | Meyer | H01R 9/2416 |

FOREIGN PATENT DOCUMENTS

| | | | | |
|---|---|---|---|---|
| CN | 108075254 | A * | 5/2018 | |
| DE | 34 24 482 | A1 | 1/1986 | |
| DE | 201 20 811 | U1 | 6/2003 | |
| DE | 102 53 858 | A1 | 6/2004 | |
| DE | 10 2005 043 877 | A1 | 3/2007 | |
| DE | 10 2013 105 263 | B3 | 9/2014 | |
| DE | 10 2013 107 292 | A1 | 1/2015 | |
| EP | 3038213 | A1 * | 6/2016 | H01R 4/4836 |
| JP | 2004-165045 | A | 6/2004 | |
| JP | 6400607 | B2 * | 10/2018 | H01R 4/4836 |

* cited by examiner

*Primary Examiner* — Travis S Chambers

(74) *Attorney, Agent, or Firm* — Muncy, Geissler, Olds & Lowe, P.C.

(57) ABSTRACT

A conductor terminal for connecting an electrical conductor by means of spring force clamping, the conductor terminal being configured for mounting on a busbar, the terminal conductor including at least one spring force clamping connection having a clamping spring for clamping the electrical conductor, a housing, which at least partially surrounds the spring force clamping connection and has a conductor insertion opening and a pivotably supported actuation lever, which is configured to actuate at least one part of the clamping spring, a receiving space for receiving at least one section of the busbar onto which the conductor terminal may be mounted, being present in the housing.

20 Claims, 4 Drawing Sheets

CONDUCTOR TERMINAL

This nonprovisional application claims priority under 35 U.S.C. § 119(a) to German Patent Application No. 10 2019 131 653.7, which was filed in Germany on Nov. 22, 2019, and which is herein incorporated by reference.

BACKGROUND OF THE INVENTION

Field of the Invention

The present invention relates to a conductor terminal for connecting an electrical conductor by means of spring force clamping, the conductor terminal being configured for mounting on a busbar.

Description of the Background Art

A conductor terminal of is known from DE 10 2013 107 292 A1.

SUMMARY OF THE INVENTION

It is therefore an object of the present invention to further optimize a conductor terminal of this type.

This object is achieved by a conductor terminal for connecting an electrical conductor by means of spring force clamping, the conductor terminal being configured for mounting on a busbar, the terminal conductor including at least one spring force clamping connection including a clamping spring for clamping the electrical conductor, a housing, which at least partially surrounds the spring force clamping connection and has a conductor insertion opening and a pivotably supported actuating lever, which is configured to actuate at least one part of the clamping spring, a receiving space for receiving at least one section of the busbar being present in the housing, onto which the conductor terminal may be mounted. The conductor terminal according to the invention may be implemented with a simple and compact structure in this way. An easy and secure lever actuation with a secure clamping action may be implemented. The conductor terminal permits an easy latching or other mounting on the busbar.

The electrical conductor to be clamped may be inserted through the conductor insertion opening into the housing in a conductor insertion direction and guided to a clamping point of the spring force clamping connection. A conductor insertion channel may be adjacent to the conductor insertion opening within the housing. According to one advantageous embodiment of the invention, the conductor insertion channel and the receiving space are arranged with respect to each other in such a way that they transition into each other, so that a busbar received in the receiving space projects at least partially into the conductor insertion channel At least one area of the actuating lever can be adjacent to the receiving space of the busbar or projects into the receiving space of the busbar. In this way, the actuating lever may use the surface of the busbar at least in part as a supporting and sliding surface during the pivoting movement. The structure of the conductor terminal may therefore be simplified, since, in particular, the support of the actuating lever necessary for the pivoting movement requires less complexity with respect to the structural design of the conductor terminal.

At least a portion of the actuating lever may be supported on the busbar received in the receiving space, at least during the pivoting movement of the actuating lever. The actuating lever may thus slide at least in part along the surface of the busbar during the pivoting movement.

The conductor terminal can include positioning elements for positioning the busbar relative to the receiving space in an installation position, in which the busbar is arranged at an angle with respect to the conductor insertion direction. In this way, a particular position of the section of the busbar present in the receiving space is defined by the positioning elements with respect to the conductor insertion direction and thus also in relation to the clamped electrical conductor. The busbar may thus be fixed in the installation position by the positioning elements. Due to this installation position of the busbar, the electrical conductor is arranged, in particular, not in parallel to the busbar but rather at a certain angle thereto, for example at an acute angle. The angle between the conductor insertion direction and the surface of the busbar facing the electrical conductor may be, for example, in the range of 5 degrees to 45 degrees. This permits a particularly reliable clamping of the electrical conductor, the section of the busbar present in the receiving space being usable for clamping the electrical conductor. Due to the angled guidance of the electrical conductor to the surface of the busbar, a contact of the electrical conductor over a large area of the busbar is avoided.

The positioning elements can include one or multiple latching elements, by means of which the conductor terminal is connectable to the busbar in a latching manner. This ensures a n easy latching of the conductor terminal to the busbar. In particular, the conductor terminal may be designed in such a way that no positioning elements need to be manually actuated separately to connect the conductor terminal to the busbar. The housing of the conductor terminal may be designed as a housing made up of one or multiple components, the housing being able to be provided with a rigid design overall with its one or multiple components. A joint for opening or closing the housing is not necessary.

The receiving space can extend all the way through the conductor terminal in a transverse direction, which runs orthogonally to the conductor insertion direction. The housing of the conductor terminal, which may be designed, for example, as an insulating material housing, is thus open to the side in the area of the receiving space. As a result, the conductor terminal may be also mounted on a busbar which has a relatively great longitudinal extension.

The clamping spring can have a contact leg, a spring bend adjacent to the contact leg and a clamping leg adjacent to the spring bend for firmly clamping the electrical conductor. The clamping spring may be supported by the contact leg on a portion of the conductor terminal against the clamping force of the clamping leg. The electric conductor may be firmly clamped by the clamping force of the clamping leg. For this purpose, the conductor terminal may have, for example, a busbar, against which the electrical conductor is pressed with the aid of the clamping leg, or an area of the surface of the busbar may be used to clamp the electrical conductor. The clamping leg may act upon the busbar directly or via one or multiple additional elements, for example a busbar and/or the clamped-on electrical conductor.

The conductor terminal can include a holding frame, on which the contact leg is held, e.g. in that the contact leg is received, suspended or fixed in this location. The holding frame may be designed, for example, as a metal part. The holding frame may have an opening bordered by webs on the circumferential side, through which at least one free end of the electrical conductor to be clamped may be inserted. The contact leg may be suspended, on the holding frame, for example on the inner circumference of the opening.

The holding frame can include a tension element or is coupled with a tension element. At the tension element, the busbar may be supported in the receiving space against a clamping force of the clamping leg acting upon the busbar. A pure tensile force may be transferred from the busbar to the fastening point of the contact leg by the tension element, which may be designed, for example, as a tension rod. The spring force clamping connection may be held in a self-supporting manner on the busbar via the tension element. In the case of a self-supporting system of this type, no or only negligible forces of the clamping spring are transferred to the housing. In particular, a closed flux of force may be established hereby between the tension element, the holding frame and the busbar.

A free end of the clamping leg can be positioned in such a way that a clamping point for clamping the electrical conductor is formed between a free end and a surface of a busbar facing the clamping leg and situated in the receiving space. The busbar may be used in this manner as a clamping surface for the electrical conductor. The conductor terminal may therefore be designed without its own busbar, i.e. in a busbar-less manner. The structure of the conductor terminal may be further simplified hereby.

An electrical conductor clamped at the clamping point may be clamped between the free end of the clamping leg and a corner edge of the busbar. This permits a particularly reliable clamping of an electrical conductor at the clamping point. For this purpose, the receiving space may include positioning elements, which position the busbar received in the receiving space in such a way that a corner edge is positioned with respect to the free end of the clamping leg in such a way that a clamped electrical conductor may be clamped between the free end and the corner edge.

The clamping leg may have a clamping edge on its free end. The reliability of the clamping of the electrical conductor is further improved hereby.

The housing can have an introduction opening, through which a section of the busbar may be introduced into the receiving space of the conductor terminal. The introduction opening may be arranged on the same housing side of the housing as the conductor insertion opening or on a housing side of the housing facing away from an actuation side of the conductor terminal. The actuation side of the conductor terminal is a side, on which a manual actuating element of the actuating lever is accessible for the manual actuation. This permits, in particular, an easy introduction of the section of the busbar into the receiving space or an easy plugging of the conductor terminal onto the busbar.

The actuating lever can be provided with a U-shaped design, viewed in the conductor insertion direction, including a first and a second bearing plate in each case, which are connected to each other via a connecting area of the actuating lever, an intermediate space for inserting the electrical conductor to be clamped being present between the first and second bearing plates. Due to a construction of this type, the actuating lever may transfer high actuating forces to the clamping spring with a compact design. The conductor terminal as a whole may also be provided with a very compact design, since the intermediate space between the bearing plates may be used for inserting the electrical conductor.

The first and second bearing plates may be supported, for example, on the surface of the busbar and slide thereon when a pivoting movement of the actuating lever is carried out.

The U-shaped part of the actuating lever can have an open side, which is positioned in such a way that it may be covered by the surface of the busbar received in the receiving space. The open side of the U shape may thus be closed by the busbar received in the receiving space.

The first and the second bearing plates can form a guide for the electrical conductor guided through the intermediate space in each actuation position of the actuating lever. As a result, a guidance for the electrical conductor is already provided by the actuating lever. The guidance may be ensured by the first and second bearing plates in each operating state of the conductor terminal, in particular in each pivoting position of the actuating lever. The conductor terminal may include additional conductor guiding elements, as further explained below.

The conductor terminal can have only one single spring for a particular spring force clamping connection, namely the clamping spring of the spring force clamping connection. The conductor terminal is provided hereby with a simple design having only a few components. This simplifies both the manufacturing and the assembly of the conductor terminal.

The clamping spring can be provided with an essentially V-shaped design. In this way, the spring force clamping connection may be designed as a direct plug connection. In the case of a direct plug connection, an electrical conductor may be inserted directly into the clamping point without actuating the actuating lever if it is sufficiently stiff (for example a single-wire connector) and firmly clamped with the aid of the clamping leg. An actuation of the actuating lever is necessary only to remove the clamped electrical conductor from the clamping point.

The actuating lever may have, for example, an open position and a closed position. In the open position, the clamping point is opened, i.e. the clamping leg is removed from the mating piece used for clamping (for example the conductor rail or busbar) to the extent that an electrical conductor may be inserted into or removed from the clamping point without the application of force. In the closed position, the clamping leg is effective with respect to firmly clamping the electrical conductor at the clamping point.

The actuating lever may be supported in a movable and/or floating manner in the conductor terminal, in particular in the area of its bearing. In particular, the actuating lever may assume a slightly different position in the area of its bearing in the conductor terminal if no busbar is arranged in the receiving space, compared to the state of a busbar disposed in the receiving space. In other words, the actuating lever may be displaced a certain (generally relatively short) distance by the busbar in the area of its bearing due to the introduction of the busbar into the receiving space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
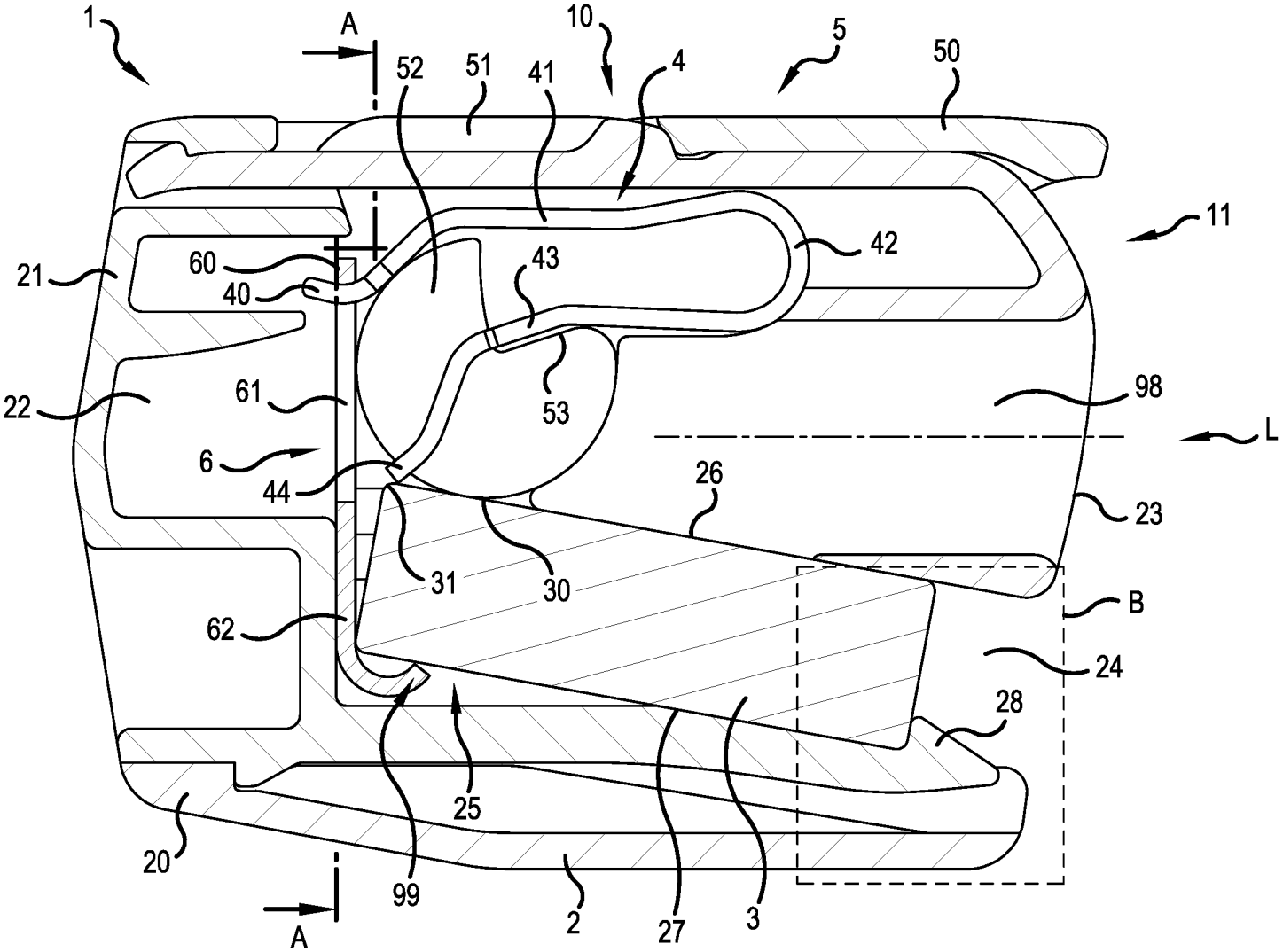
FIG. 1 shows a side sectional representation of a conductor terminal.

Conductor terminal 1 illustrated in FIG. 1 includes a housing 2, a clamping spring 4, an actuating lever 5 and a holding frame 6. Housing 2 may, for example, be provided with a two-part design, including a first housing component 20 and a second housing component 21. First and second housing components 20, 21 may be fastened to each other via positioning elements, for example in that they are latched to each other. Clamping spring 4 and holding frame 6 are arranged in the area surrounded by housing 2. FIG. 1 also shows a busbar 3, to which conductor terminal 1 is fastened.

Housing 2 includes a conductor receiving chamber 22, a conductor insertion opening 23, an introduction opening 24, a receiving space 25 for receiving a section of busbar 3 as well as positioning elements 26, 27, 28, which are used to position busbar 3 relative to receiving space 25 in a defined installation position. Conductor receiving chamber 22 may be formed, for example, by a part of second housing component 21, and the remaining mentioned elements of housing 2 may be formed on first housing component 20. Conductor insertion opening 23 is situated on a conductor insertion side 11 of conductor terminal 1. A conductor insertion channel 98, which may, for example, be at least partially surrounded by walls of housing 2, is adjacent to conductor insertion opening 23 in the interior of housing 2.

An electrical conductor which is to be connected to conductor terminal 1, may be guided through conductor insertion opening 23 in a conductor insertion direction L to a subsequent clamping point explained in greater detail below. Introduction opening 24 is used to introduce a section of busbar 3 into receiving space 25. If this section of busbar 3 is introduced all the way, the state illustrated in FIG. 1 results, in which receiving space 25 is filled to the greatest extent by this section of busbar 3. As is apparent, busbar 3 projects at least a little way into conductor insertion channel 98.

Positioning elements 26, 27 may be designed, for example, as sliding edges of housing 2 situated opposite each other, at which the busbar is guided into receiving space 25 during its introduction through introduction opening 24 and is ultimately held in the installation position. Positioning element 28 may be designed as a latching element, which is disposed on a resilient latching tongue of housing 2. This latching tongue yields slightly when busbar 3 is introduced and then snaps back when busbar 3 reaches its installation position in receiving space 25, whereby busbar 3 is fixed in receiving space 25 by the latching. The position of busbar 3 may be fixed on the side facing away from positioning element 28, for example by holding frame 6.

Clamping spring 4 has a contact leg 41, a spring bend 42 adjacent to contact spring 41 and a clamping leg 43 adjacent to spring bend 42. The contact leg is fixed on holding frame 6 via its free end 40, where it is supported, for example in that free end 40 is suspended there behind a web 60 of holding frame 6. In this way, web 60 may form a first bearing 60 for receiving contact leg 41. Clamping leg 43 ends at a free end 44, at which a clamping edge may be present. An electrical conductor may be clamped on a surface 30 of busbar 3 with the aid of free end 44 or the clamping edge. The clamping point of the spring force clamping connection implemented in this way is thus formed between free end 44 or the clamping edge of clamping leg 43 and surface 30 of busbar 3. The clamping point may be formed, in particular, with the aid of corner edge 31 of busbar 3.

Holding frame 6 has a recess 61. An electrical conductor to be clamped, which is inserted through conductor insertion opening 23, is first guided through conductor insertion channel 98 adjacent to conductor insertion opening 23. The guidance of the electrical conductor by laterally situated bearing plates 52 in each case, takes place in the area of actuating lever 5. Clamping leg 43 and surface 30 of busbar 3 also participate in the conductor guidance. The electrical conductor may be inserted through recess 61 up to conductor receiving chamber 22, by means of which an end stop for limiting the depth of the introduction of the electrical conductor is also formed.

Holding frame 6 is continued by a tension element 62 beneath recess 61, behind which busbar 3 is suspended. Tension element 62 may end, for example, with a bent free end, which forms a second bearing 99, on which busbar 3 rests. Clamping spring 4 directly or indirectly transfers a clamping force through clamping leg 43 onto busbar 3. Busbar 3 is supported against this clamping force by tension element 62, which, in turn, is connected to contact leg 41 via holding frame 6. A self-supporting contact insert of conductor terminal 1 is implemented in this way.

Actuating lever 5 is accessible for the purpose of manual actuation on an actuation side 10 of conductor terminal 1. Actuating lever 5 includes a manual actuating element 50, at which actuating lever 5 may be manually actuated. Actuating lever 5 transitions from manual actuating element 50 to an area, in which actuating lever 5 forks into side plates 51 situated in each case on the left and the right. Side plates 51 may extend laterally, for example even beyond holding frame 6, Particular spring actuating bodies, at each of which a first and a second bearing plate 52 is situated, are mounted on insides of side plates 51 facing each other. Actuating lever 5 is pivotable, i.e. rotatable, via bearing plates 52, supported in conductor terminal 1 and may be supported, in particular, on surface 30 of busbar 3. In this case, actuating lever 5 slides with bearing plates 52 on busbar 3 during a pivoting movement.

The spring actuating bodies each have a V-shaped incision, by means of which a particular actuating edge 53 is formed. Actuating edge 53 acts upon clamping leg 43. If actuating lever 5 is pivoted from the closed position illustrated in FIG. 1 into an open position, in that it is pivoted counterclockwise by an angle of approximately 90 degrees, clamping leg 43 is deflected upwardly in the direction of contact leg 41 by actuating edge 53, whereby free end 44 or the clamping edge is moved forward by busbar 3.

Figure 2:
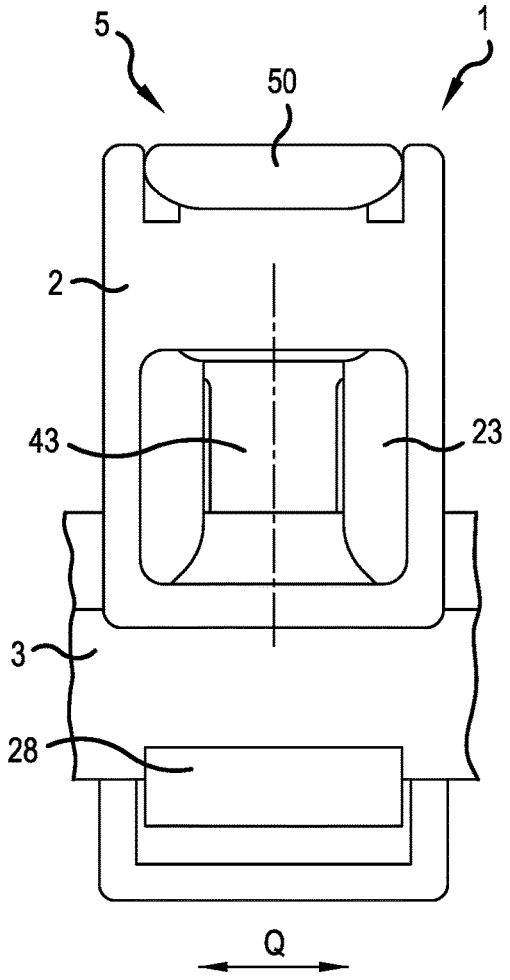
FIG. 2 shows the conductor terminal according to FIG. 1 in a view of a conductor insertion side.

FIG. 2 shows conductor terminal 1 in a top view of conductor insertion side 11. Busbar 3 extends in transverse direction Q all the way through housing 2, i.e. receiving space 25 also extends all the way through conductor terminal 1 in transverse direction Q.

Figure 3:
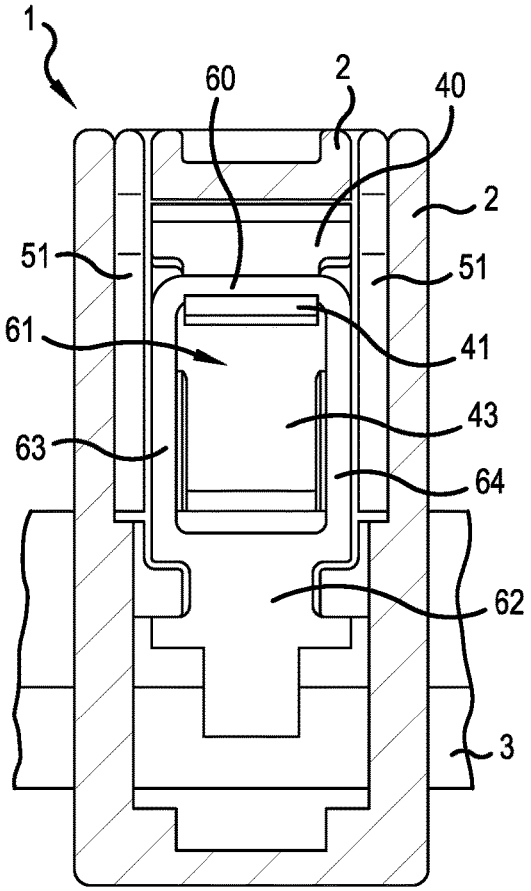
FIG. 3 shows a sectional view of the conductor terminal according to section line A-A drawn in FIG. 1.

FIG. 3 shows a sectional representation of conductor terminal 1 according to section line A-A in FIG. 1. The elements explained above are additionally clarified hereby.

It is apparent, in particular in FIG. 3, that holding frame 6 has a recess 61, which is limited by webs 60, 63, 64 as well as downwardly by the adjacent area of tension element 62 on the side of recess 61 opposite web 60.

Figure 4:
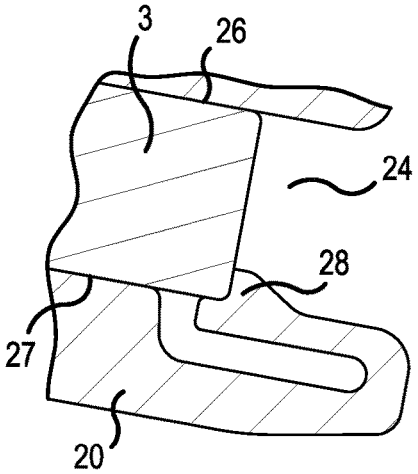
FIG. 4 shows an alternative specific embodiment of the conductor terminal in area B marked in FIG. 1.

FIG. 4 shows an alternative specific embodiment of the latching fastening of busbar 3 with the aid of positioning element 28. In the specific embodiment in FIG. 4, positioning element 28 is guided from first housing component 20 to a side edge of busbar 3 via an arm bent into a U shape.

Figure 5:
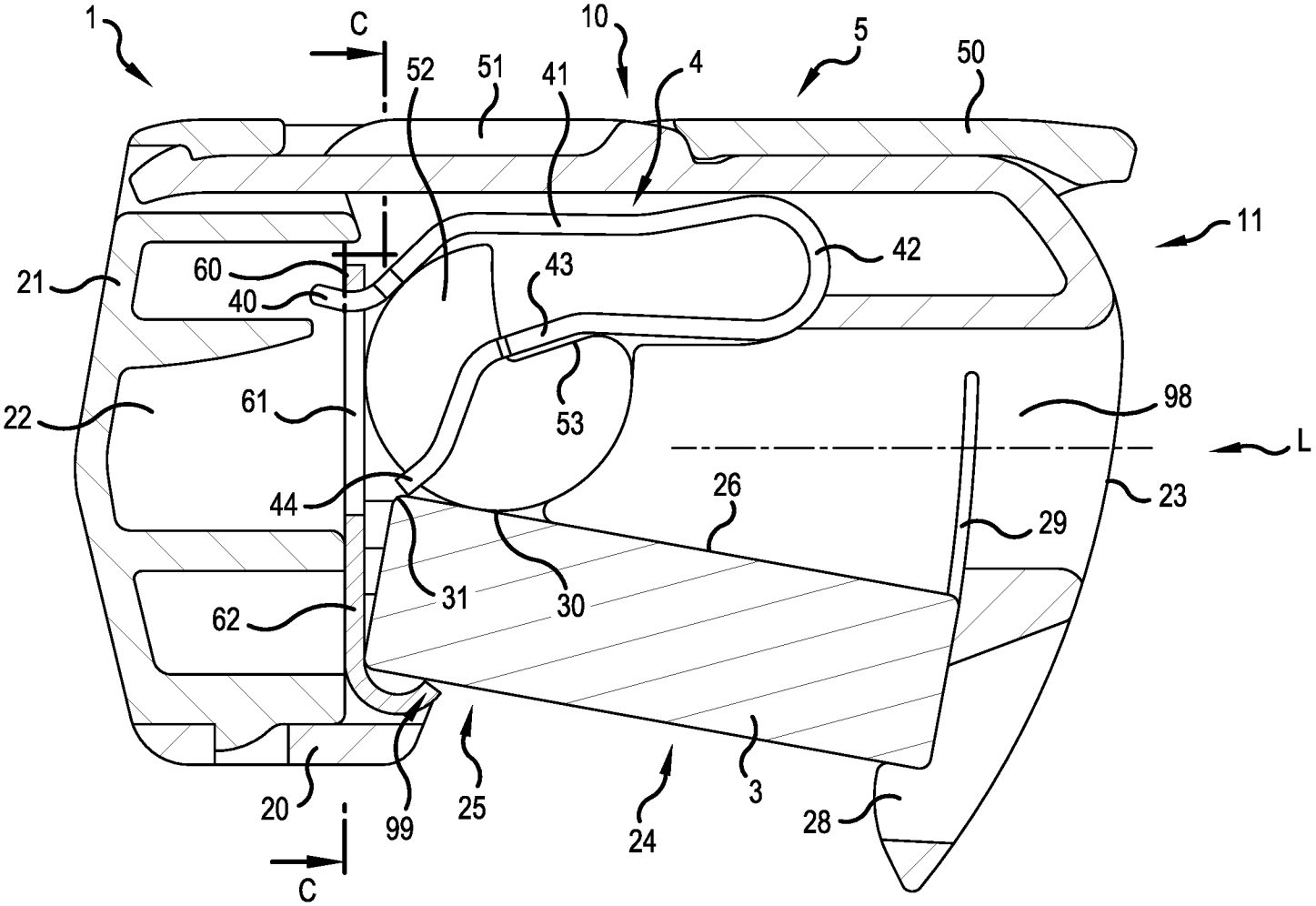
FIG. 5 shows a side sectional representation of a further specific embodiment of a conductor terminal.
Figure 6:
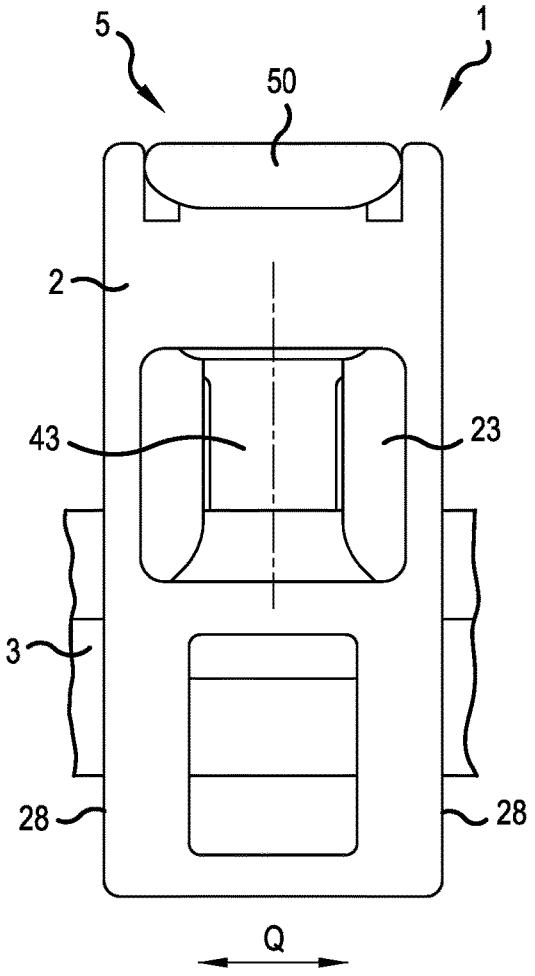
FIG. 6 shows the conductor terminal according to FIG. 5 in a view of a conductor insertion side.
Figure 7:
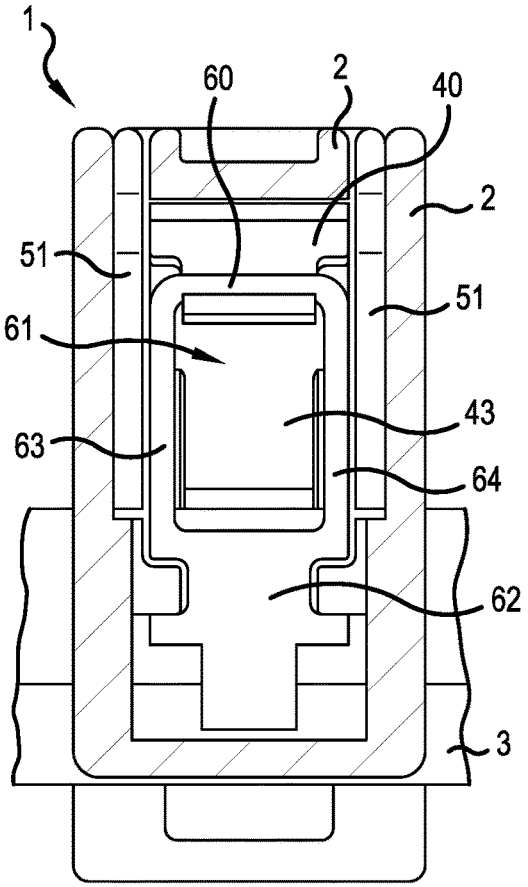
FIG. 7 shows a sectional view of the conductor terminal according to section line C-C drawn in FIG. 5.

While introduction opening 24 is disposed on the same housing side of housing 2 as conductor insertion opening 23 in the specific embodiments of conductor terminal 1 explained up to now, namely on conductor insertion side 11, a variant in which introduction opening 24 is arranged on the housing side of housing 2 facing away from actuation side 10, based on the specific embodiment of conductor terminal 1 illustrated in FIGS. 5 through 7. In other words, in the specific embodiment in FIGS. 5 through 7, the section of busbar 3 is inserted into housing 2, so to speak from below.

It is apparent that only positioning elements 26, 28 are present in this case. Busbar 3 is inserted into receiving space 25 in such a way that it is first pushed in between free end 44 of clamping leg 43 and tension element 62 and then engaged behind positioning element 28 by means of a tilting movement. To ensure a sufficient movability of the latching tongue connected to positioning element 28, housing 2, in particular first housing part 20, may have an elongated notch or incision 29.

As shown, in particular by FIG. 6, positioning element 28 does not have to be a continuous latching element in transverse direction Q but may be implemented by two individual latching elements in the area of the side walls of housing 2, which are connected to each other by a transverse web below introduced busbar 3. A tool, for example a screwdriver, may be introduced into the intermediate space or opening formed in this manner, so as to deflect positioning element 28 and lift up the latching connection between housing 2 and the busbar so that conductor terminal 1 may be removed from the busbar.

The conductor terminal according to FIGS. 5 through 7 otherwise has a design comparable to the specific embodiment described first.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal for connecting an electrical conductor via spring force clamping, the conductor terminal being configured to be mounted on a busbar, the terminal conductor comprising:

at least one spring force clamping connection having a clamping spring for clamping the electrical conductor;

a housing, which at least partially surrounds the spring force clamping connection and has a conductor insertion opening and a pivotably supported actuating lever, which is configured to actuate at least one part of the clamping spring, and the housing having a receiving space for receiving at least one section of the busbar onto which the conductor terminal is mounted, wherein at least one part of the actuating lever is directly adjacent to the receiving space of the busbar or projects into the receiving space of the busbar.

2. The conductor terminal according to claim 1, wherein the actuating lever is positioned such that the at least one part of the actuating lever is supported on the busbar received in the receiving space, at least during the pivoting movement of the actuating lever.

3. The conductor terminal according to claim 1, wherein the receiving space extends all the way through the conductor terminal in a transverse direction, which runs orthogonally to a conductor insertion direction.

4. The conductor terminal according to claim 1, wherein the at least one part of the actuating lever that is directly adjacent to the receiving space of the busbar or that projects into the receiving space of the busbar is a first bearing plate and a second bearing plate.

5. The conductor terminal according to claim 1, wherein the clamping spring has a contact leg, a spring bend adjacent to the contact leg and a clamping leg adjacent to the spring bend for firmly clamping the electrical conductor.

6. The conductor terminal according to claim 5, wherein the conductor terminal includes a holding frame on which the contact leg is held.

7. The conductor terminal according to claim 6, wherein the holding frame includes a tension element or is coupled with a tension element.

8. The conductor terminal according to claim 6, wherein the holding frame includes a first bearing for receiving the contact leg and a second bearing for positioning the busbar.

9. The conductor terminal according to claim 1, wherein the housing has an introduction opening through which a section of the busbar is introduced into the receiving space of the conductor terminal.

10. The conductor terminal according to claim 9, wherein the introduction opening is arranged on a same housing side of the housing as the conductor insertion opening or on a housing side of the housing facing away from an actuation side of the conductor terminal, the actuation side of the conductor terminal being a side on which a manual actuating element of the actuating lever is accessible for manual actuation.

11. The conductor terminal according to claim 1, wherein the actuating lever is provided with a U-shaped part, viewed in a conductor insertion direction, including a first bearing plate and a second bearing plate which are connected to each other via a connecting area of the actuating lever, wherein an intermediate space for inserting the electrical conductor to be clamped is present between the first bearing plate and second bearing plate.

12. The conductor terminal according to claim 11, wherein the U-shaped part of the actuating lever has an open side, which is positioned such that the open side is covered by a surface of the busbar received in the receiving space.

13. The conductor terminal according to claim 11, wherein the first bearing plate and the second bearing plate form a guide for the electrical conductor guided through the intermediate space in each actuation position of the actuating lever.

14. A conductor terminal for connecting an electrical conductor via spring force clamping, the conductor terminal being configured to be mounted on a busbar, the terminal conductor comprising:

at least one spring force clamping connection having a clamping spring for clamping the electrical conductor;

a housing, which at least partially surrounds the spring force clamping connection and has a conductor insertion opening and a pivotably supported actuating lever, which is configured to actuate at least one part of the clamping spring, and the housing having a receiving space for receiving at least one section of the busbar onto which the conductor terminal is mounted, wherein the conductor terminal includes positioning elements for positioning the busbar relative to the receiving space in an installation position, in which the busbar is arranged at an angle with respect to the conductor insertion direction.

15. The conductor terminal according to claim 14, wherein the position and/or location of the busbar relative to a clamping leg of the clamping spring and/or to a free end of the clamping leg of the clamping spring is fixed by the positioning elements.

16. The conductor terminal according to claim 14, wherein the positioning elements include one or multiple latching elements, with the aid of which the conductor terminal is connectable in a latching manner with the busbar.

17. A conductor terminal for connecting an electrical conductor via spring force clamping, the conductor terminal being configured to be mounted on a busbar, the terminal conductor comprising:

at least one spring force clamping connection having a clamping spring for clamping the electrical conductor;

a housing, which at least partially surrounds the spring force clamping connection and has a conductor insertion opening and a pivotably supported actuating lever, which is configured to actuate at least one part of the clamping spring, and the housing having a receiving space for receiving at least one section of the busbar onto which the conductor terminal is mounted, wherein a conductor insertion channel adjacent to the conductor insertion opening and the receiving space are arranged with respect to each other such that they transition into each other, so that the busbar received in the receiving space projects at least partially into the conductor insertion channel.

18. A conductor terminal for connecting an electrical conductor via spring force clamping, the conductor terminal being configured to be mounted on a busbar, the terminal conductor comprising:

at least one spring force clamping connection having a clamping spring for clamping the electrical conductor;

a housing, which at least partially surrounds the spring force clamping connection and has a conductor insertion opening and a pivotably supported actuating lever, which is configured to actuate at least one part of the clamping spring, and the housing having a receiving space for receiving at least one section of the busbar onto which the conductor terminal is mounted, wherein the clamping spring has a contact leg, a spring bend adjacent to the contact leg and a clamping leg adjacent to the spring bend for firmly clamping the electrical conductor, wherein the conductor terminal includes a holding frame on which the contact leg is held, wherein the holding frame includes a tension element or is coupled with a tension element, and wherein the busbar is supported on the tension element in the receiving space against a clamping force of the clamping leg acting upon the busbar.

19. A conductor terminal for connecting an electrical conductor via spring force clamping, the conductor terminal being configured to be mounted on a busbar, the terminal conductor comprising:

at least one spring force clamping connection having a clamping spring for clamping the electrical conductor;

a housing, which at least partially surrounds the spring force clamping connection and has a conductor insertion opening and a pivotably supported actuating lever, which is configured to actuate at least one part of the clamping spring, and the housing having a receiving space for receiving at least one section of the busbar onto which the conductor terminal is mounted, wherein the clamping spring has a contact leg, a spring bend adjacent to the contact leg and a clamping leg adjacent to the spring bend for firmly clamping the electrical conductor, and wherein a free end of the clamping leg is positioned such that a clamping point for clamping the electrical conductor is formed between the free end and a surface of the busbar facing the clamping leg and situated in the receiving space.

20. The conductor terminal according to claim 19, wherein the receiving space includes positioning elements, which position the busbar received in the receiving space such that a corner edge of the surface of the busbar is positioned with respect to the free end of the clamping leg such that a clamped electrical conductor is clamped between the free end and the corner edge.

* * * * *